US008907567B2

(12) United States Patent
Kuwabara et al.

(10) Patent No.: US 8,907,567 B2
(45) Date of Patent: Dec. 9, 2014

(54) PLASMA LIGHT SOURCE AND PLASMA LIGHT GENERATION METHOD

(75) Inventors: Hajime Kuwabara, Tokyo (JP); Kazuhiko Horioka, Kanagawa (JP)

(73) Assignees: IHI Corporation, Tokyo (JP); Tokyo Institute of Technology, Tokyo (JP)

( * ) Notice: Subject to any disclaimer, the term of this patent is extended or adjusted under 35 U.S.C. 154(b) by 553 days.

(21) Appl. No.: 13/140,789

(22) PCT Filed: Dec. 4, 2009

(86) PCT No.: PCT/JP2009/070403

§ 371 (c)(1),
(2), (4) Date: Jun. 17, 2011

(87) PCT Pub. No.: WO2010/071036

PCT Pub. Date: Jun. 24, 2010

(65) Prior Publication Data

US 2011/0248635 A1 Oct. 13, 2011

(30) Foreign Application Priority Data

Dec. 18, 2008 (JP) ..... 2008-322526

(51) Int. Cl.
*H01J 7/24* (2006.01)
*G21K 1/02* (2006.01)
*H05G 2/00* (2006.01)

(52) U.S. Cl.
CPC ..... *G21K 1/025* (2013.01); *H05G 2/005* (2013.01); *H05G 2/006* (2013.01); *H05G 2/003* (2013.01)
USPC ..... 315/111.71; 315/111.21

(58) Field of Classification Search
CPC ..... H05G 2/003; H05G 2/005; B82Y 10/00; G03F 7/70033; G03F 7/70166
USPC ..... 250/504 R, 493.1; 315/111.21, 111.71
See application file for complete search history.

(56) References Cited

U.S. PATENT DOCUMENTS

| | | | | |
|---|---|---|---|---|
| 6,566,667 | B1 * | 5/2003 | Partlo et al. | 250/504 R |
| 7,115,887 | B1 | 10/2006 | Hassanein et al. | |
| 2006/0232215 | A1 | 10/2006 | Bogatu | |
| 2007/0001571 | A1 | 1/2007 | Bosch et al. | |

FOREIGN PATENT DOCUMENTS

| | | | |
|---|---|---|---|
| JP | 10-189288 | A | 7/1998 |
| JP | 11-229124 | | 8/1999 |
| JP | 2001-215721 | A | 8/2001 |
| JP | 2004226244 | A | 8/2004 |
| WO | 01/37309 | A1 | 5/2001 |

OTHER PUBLICATIONS

Hiroto Sato et al., "Discharge-Produced Plasma EUV Source for Microlithography," OQD-08-28, pp. 17-22.

(Continued)

*Primary Examiner* — Thienvu Tran
(74) *Attorney, Agent, or Firm* — Griffin & Szipl, P.C.

(57) ABSTRACT

A plasma light source includes a pair of coaxial electrodes 10 facing each other, a radiation environment sustaining device 20 that supplies a plasma medium into the insides of the coaxial electrodes and holds the coaxial electrodes at a temperature and a pressure suitable for plasma generation, and a voltage application device 30 that applies a discharge voltage of an inverted polarity to each of the coaxial electrodes. Tubular discharge 4 is formed between the pair of coaxial electrodes and plasma 3 is confined in an axial direction of the coaxial electrodes.

7 Claims, 11 Drawing Sheets

(56) References Cited

OTHER PUBLICATIONS

Jeroen Jonkers, "High Power Extreme Ultra-Violet (EUV) Light Sources for Future Lithography," Plasma Sources Science and Technology, 15 (2006) S9-S16.

Yutaka Aoyama et al., "Plasma Dynamics of Counter-streaming Z-pinch," PST-08-101, pp. 1-5.

International Search Report issued in corresponding International Application No. PCT/JP2009/070403, completed Feb. 3, 2010, mailed Feb. 16, 2010.

Office Action received on May 13, 2013 in corresponding Japanese application No. 2008-322526.

Yutaka Aoyama, Mitsuo Nakajima, Kazuhiko Horioka, Counter-facing plasma focus system as a repetitive and/or long-pulse high energy density plasma source, Physics of plasmas, Nov. 2009, vol. 16 No. 11, 110701.

Yutaka Aoyama, Mitsuo Nakajima, Kazuhiko Horioka, "Taiko z-pinch no Plasma Dynamics", The Institute of Electrical Engineers of Japan Plasma Kenyukai Shiryo, 20 ecember 28 (Dec. 20, 2008), pp. 17-21.

Extended European Search Report issued in corresponding application 09833340.4, completed May 22, 2012 and mailed May 30, 2012.

* cited by examiner

PLASMA LIGHT SOURCE AND PLASMA LIGHT GENERATION METHOD

This is a National Phase Application in the United States of International Patent Application No. PCT/JP2009/070403 filed Dec. 4, 2009, which claims priority on Japanese Patent Application No. 2008-322526, filed Dec. 18, 2008. The entire disclosures of the above patent applications are hereby incorporated by reference.

BACKGROUND OF THE INVENTION

1. Technical Field of the Invention

The present invention relates to a plasma light source for EUV (Extreme Ultra Violet) radiation and a plasma light generation method.

2. Description of the Related Art

Lithography using EUV light sources has been expected for microprocessing of next-generation semiconductors. Lithography is a technique to fabricate an electronic circuit by reduction-projecting light or beam onto a silicon-substrate through a mask with a circuit pattern drawn thereon to expose a resist material to light. Minimum processing dimensions of a circuit fabricated by optical lithography basically depend on the wavelength of a light source. Thus, a shorter-wavelength light source is essential for the development of next-generation semiconductors, and research has been carried out for the development of such light sources.

A highest potential light source for next-generation lithography is an EUV light source, meaning light in the wavelength ranging from about 1 to 100 nm. Since light in this range has a high absorptance for all substances so that transmission optical systems such as a lens cannot be used, a reflection optical system has to be used. It is very difficult to develop optical systems in an EUV range, and such optical systems show a reflection property only for limited wavelengths.

A reflecting mirror formed by multilayer of Mo/Si to have sensitivity at 13.5 nm has been already developed, and it is expected that the development of a lithography technique using light of this wavelength in combination with the reflecting mirror will enable processing dimensions of 30 nm or less. To realize further advanced microprocessing techniques, the development of a lithography light source with the wavelength of 13.5 nm is urgently required, and radiant light from high energy density plasma attracts attention.

Generation methods for light source plasma can be classified roughly into laser produced plasma (LPP) types and discharge produced plasma (DPP) types driven by a pulsed power technique. DPP has an advantage of a conversion efficiency superior to LPP because input electric power is directly converted into plasma energy, and has an advantage of achieving a compact device and low cost.

A conversion efficiency (Plasma Conversion Efficiency: P.C.E) from plasma to radiant light in an effective wavelength band (in-band) is represented by the following expression (1):

$$\text{P.C.E}=(P_{inband}\times\tau)/E \quad (1),$$

where $P_{inband}$ is an EUV radiant light output in the in-band, $\tau$ is radiation duration, and E is energy input to plasma.

Typical elements having radiation spectra in the in-band include Xe, Sn, Li and the like. At an early stage of the development, research on Xe was mainly conducted because of the ease of handling. In recent years, however, Sn has attracted attention because of high output and high efficiency, and research on Sn is now being conducted. Additionally, there have been growing expectations for hydrogenlike Li ions ($Li^{2+}$) having a Lyman-$\alpha$ resonance line just in the in-band area.

Radiation spectra from high-temperature and high-density plasma are basically decided by a temperature and a density of a target substance. According to a result of the calculation on atomic process of plasma, for generating plasma in the EUV radiation region, optimum electronic temperatures and electronic densities are 10 to 30 eV and $10^{18}$ $cm^{-3}$, respectively, for Xe and Sn, and 20 eV and $10^{18}$ $cm^{-3}$, respectively, for Li.

The above-mentioned plasma light sources are disclosed in Non-Patent Documents 1 and 2, and Patent Document 1.

[Non-Patent Document 1]

SATO Hiroto et al. "Discharge-Produced Plasma EUV Source for Lithography", OQD-08-28

[Non-Patent Document 2]

Jeroen Jonkers, "High power extreme ultra-violet (EUV) light sources for future lithography", Plasma Sources Science and Technology, 15(2006) S8-S16

[Patent Document 1]

Japanese Patent Publication No. 2004-226244, "Extreme ultra-violet light source and semiconductor aligner"

EUV lithography light sources are required to have a high average output, a small size of light source, less flying particles (debris), and so on. In the current state, a generated EUV light amount is extremely lower than a required output, and so one of big challenges is to develop light sources with higher output. On the other hand, an increase in input energy for higher output will cause degradation in lifetime of a plasma generator and an optical system due to damage by heat load. Therefore, in order to realize both of a high EUV output and low heat load, high energy conversion efficiency is essential.

At an early stage of plasma formation, a lot of energy is consumed by heating and ionization. Additionally, since typical plasma in a high-temperature and high-density state for EUV radiation expands rapidly, the radiation duration $\tau$ is extremely short. In order to improve the conversion efficiency, it becomes important to sustain plasma for a long time (in the order of microseconds) in a high-temperature and high-density state suitable for EUV radiation.

Media such as Sn and Li that are solids at room temperatures have a high spectrum conversion efficiency. On the other hand, since such media cause a phase change such as melting and evaporation in plasma formation, influences of debris such as neutral particles (derivatives from discharging) on contamination in the device are increased. Therefore, improved target supply and recovery system also is required.

Currently a typical radiant period of an EUV plasma light source is about 100 nsec, and the output is extremely less than requirement. In order to satisfy both of high conversion efficiency and high average output for industrial application, an EUV radiant period of 1 to 5 μsec has to be achieved with one shot. That is to say, in order to develop a plasma light source with high conversion efficiency, plasma in a temperature and density state suitable for each target has to be constrained for 1 to 5 μsec (at least 1 μsec), and stable EUV radiation has to be achieved.

Further, conventional capillary discharge has a drawback of the small effective radiant solid angle because plasma is confined in a capillary.

SUMMARY OF THE INVENTION

The present invention has been created to cope with the above-stated problems. That is, it is an object of the present invention to provide a plasma light source and a plasma light generation method capable of generating plasma light for EUV radiation stably for a long time (in the order of microseconds), reducing damage to constituting devices due to heat load, increasing an effective radiant solid angle of generated plasma light, and supplying plasma media continuously.

According to the present invention, there is provided a plasma light source, comprising: a pair of coaxial electrodes facing each other; a radiation environment sustaining device that supplies a plasma medium into insides of the coaxial electrodes and holds the coaxial electrodes at a temperature and a pressure suitable for plasma generation; and a voltage application device that applies a discharge voltage of an inverted polarity to each of the coaxial electrodes, wherein tubular discharge is formed between the pair of coaxial electrodes, and plasma is confined in an axial direction of the coaxial electrodes.

According to a preferred embodiment of the present invention, each coaxial electrode includes: a rod-shaped center electrode extending along a single axial line; a tubular guide electrode surrounding the center electrode with a constant space kept therebetween; and a ring-shaped insulator positioned between the center electrode and the guide electrode and electrically insulating the center electrode from the guide electrode, and the center electrodes of the pair of coaxial electrodes are positioned along the axial line common thereto and are symmetrically positioned with a space kept therebetween.

The voltage application device includes: a positive voltage source that applies, to the center electrode of one of the pair of coaxial electrodes, a positive discharge voltage higher than a voltage at the guide electrode thereof; a negative voltage source that applies, to the center electrode of the other of the coaxial electrodes, a negative discharge voltage lower than a voltage at the guide electrode thereof; and a trigger switch that lets the positive voltage source and the negative voltage source apply a voltage to the respective coaxial electrodes concurrently.

According to another preferred embodiment of the present invention, the insulator is porous ceramic, the plasma light source further includes a plasma medium feeder that supplies a plasma medium into the inside of the coaxial electrodes via the porous ceramic, and the plasma medium feeder includes a reservoir holding the plasma medium therein and a heater liquefying the plasma medium.

According to still another preferred embodiment of the present invention, a ignition laser device is provided that applies laser light to a surface of the insulator of each of the pair of coaxial electrodes in synchronization with an application timing of the discharge voltage.

Preferably, the ignition laser device applies laser light at a plurality of positions on a surface of each insulator.

According to the present invention, there is provided a plasma light generation method, comprising the steps of:

disposing a pair of coaxial electrodes facing each other;

supplying a plasma medium into insides of the coaxial electrodes and holding the coaxial electrodes at a temperature and a pressure suitable for plasma generation;

applying a discharge voltage of an inverted polarity to each of the coaxial electrodes so as to generate sheet-discharge at each of the pair of coaxial electrodes and generate plasma at an intermediate position by the sheet-discharge between the pair of coaxial electrodes facing each other; and then converting the sheet-discharge into tubular discharge between the pair of coaxial electrodes to form magnetic field confining the plasma.

According to the above-described apparatus and method of the present invention, the apparatus includes a pair of coaxial electrodes disposed facing each other. A sheet-discharge current (sheet-discharge) is generated at each of the pair of coaxial electrodes, and the pair of sheet discharge causes plasma to be formed at an intermediate position of the opposed pair of coaxial electrodes. Next, the sheet-discharge is converted into tubular discharge between the pair of coaxial electrodes to form plasma confining magnetic field (magnetic field bottle) confining the plasma. As a result, plasma light for EUV radiation can be generated stably for a long time (in the order of microseconds).

As compared with conventional capillary discharging and vacuum discharged metal plasma, plasma is formed at an intermediate position of the opposed pair of coaxial electrodes, and energy conversion efficiency can be improved significantly. As a result, heat load to each electrode during plasma formation can be reduced so that damage to constituting devices due to heat load can be significantly reduced.

Further, since plasma as a plasma light emission source is formed at an intermediate position of the opposed pair of coaxial electrodes, an effective radiant solid angle of the generated plasma light can be increased.

The insulator is made of porous ceramic, and the plasma light source further includes a plasma medium feeder that supplies a plasma medium into the insides of the coaxial electrodes via the porous ceramic. With this configuration, the plasma medium can be supplied continuously.

DESCRIPTION OF THE PREFERRED EMBODIMENT

Figure 1:
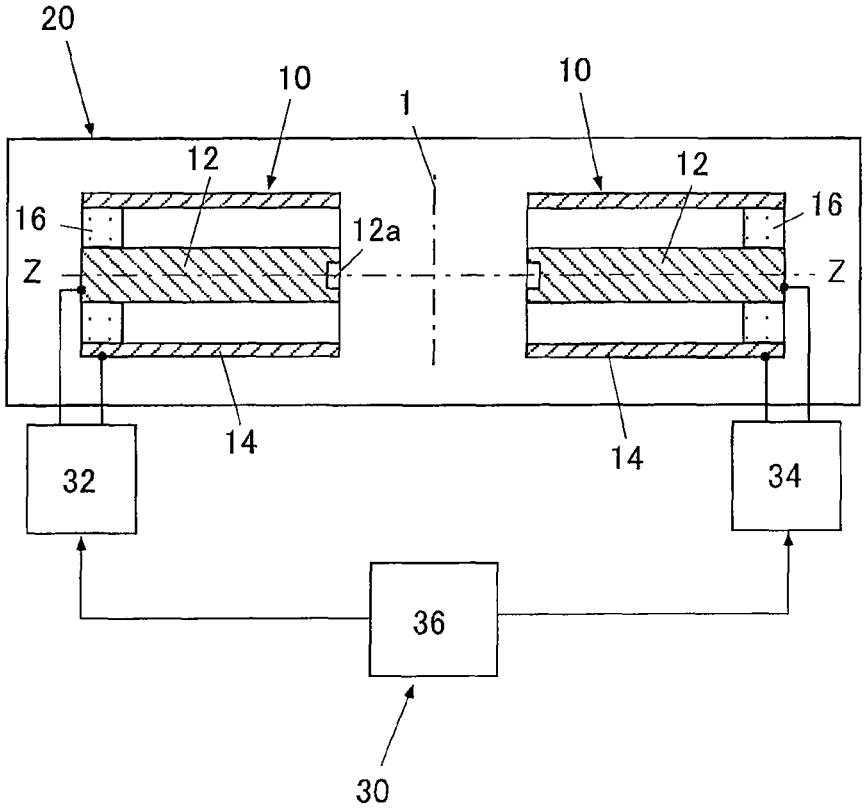
FIG. 1 illustrates a plasma light source according to Embodiment 1 of the present invention.

The following describes preferred embodiments of the present invention with reference to the attached drawings. In the drawings, same reference numerals will be assigned to common parts and duplicated description therefor will be omitted.

FIG. 1 illustrates a plasma light source according to Embodiment 1 of the present invention.

In this drawing, the plasma light source of the present invention includes a pair of coaxial electrodes 10, a radiation environment sustaining device 20 and a voltage application device 30.

The pair of coaxial electrodes 10 is disposed facing each other centering a symmetry plane 1.

Each coaxial electrode 10 includes a rod-shaped center electrode 12, a tubular guide electrode 14 and a ring-shaped insulator 16.

The rod-shaped center electrode 12 is an electrical-conductive electrode extending on and along a single axial line Z-Z. In this illustrated example, an end face of each center electrode 12, facing the symmetry plane 1, is provided with a depression 12*a* configured to stabilize a sheet-discharge current 2 and tubular discharge 4 described later. This configuration is not essential, and the end face of each center electrode 12, facing the symmetry plane 1, may have an arc shape or a flat shape.

The tubular guide electrode 14 surrounds the center electrode 12 with a constant space kept therebetween, where a plasma medium is held. The plasma medium preferably is a gas such as Xe, Sn, or Li. An end face of each guide electrode 14, facing the symmetry plane 1, may be an arc shape or a flat shape.

The ring-shaped insulator 16 is an hollow-cylindrical electrical insulator positioned between the center electrode 12 and the guide electrode 14, and electrically insulates the center electrode 12 from the guide electrode 14.

The shape of the insulator 16 is not limited to this example, and the insulator 16 may be in other shapes as long as it can electrically insulate the center electrode 12 from the guide electrode 14.

The above-stated coaxial electrodes 10 as a pair include the center electrodes 12 positioned along the common axial line Z-Z, and are symmetrically located with a space kept therebetween.

The radiation environment sustaining device 20 supplies a plasma medium to the inside of the coaxial electrodes 10, and keeps the coaxial electrodes 10 at a temperature and a pressure suitable for plasma generation.

The radiation environment sustaining device 20 may be configured with a vacuum chamber, a temperature regulator, a vacuum device and a plasma medium feeder, for example. This configuration is not essential, and other configurations also are possible.

The voltage application device 30 applies a discharge voltage of an inverted polarity to each of the coaxial electrodes 10.

In this example, the voltage application device 30 includes a positive voltage source 32, a negative voltage source 34 and a trigger switch 36.

The positive voltage source 32 applies, to the center electrode 12 of one (in the example, left side) of the coaxial electrodes 10, a positive discharge voltage higher than that at the corresponding guide electrode 14.

The negative voltage source 34 applies, to the center electrode 12 of the other (in the example, right side) of the coaxial electrodes 10, a negative discharge voltage lower than that at the corresponding guide electrode 14.

The trigger switch 36 activates the positive voltage source 32 and the negative voltage source 34 concurrently, so as to let the positive and negative discharge voltages concurrently applied to the respective coaxial electrodes 10.

With this configuration, the plasma light source of the present invention generates tubular discharge (described later) between the pair of coaxial electrodes 10 and confines plasma in the axial direction.

Figure 2A:
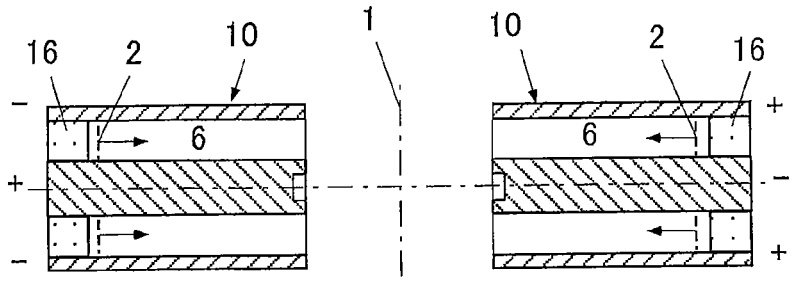
FIG. 2A illustrates a state where sheet-discharge occurs.
Figure 2B:
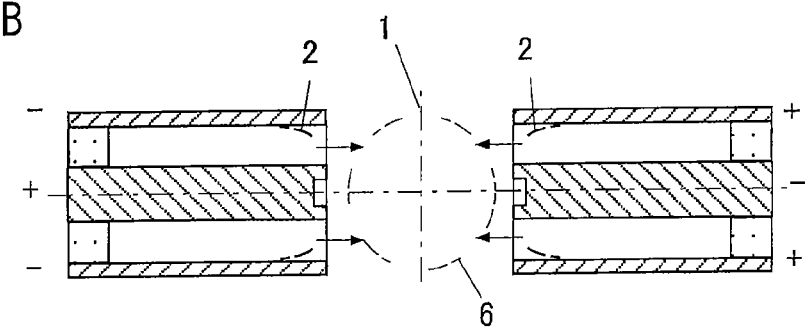
FIG. 2B illustrates a state where sheet-discharge is moving.
Figure 2C:
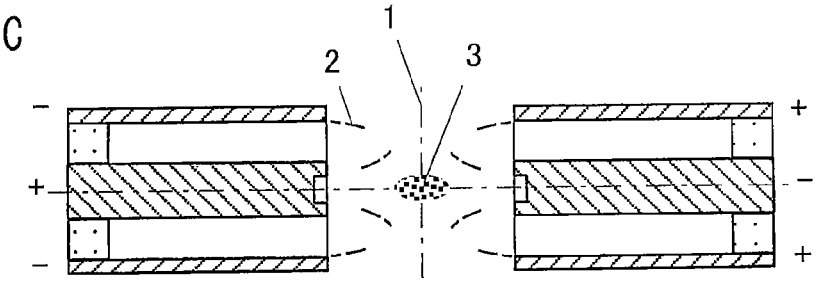
FIG. 2C illustrates a state where plasma is formed.
Figure 2D:
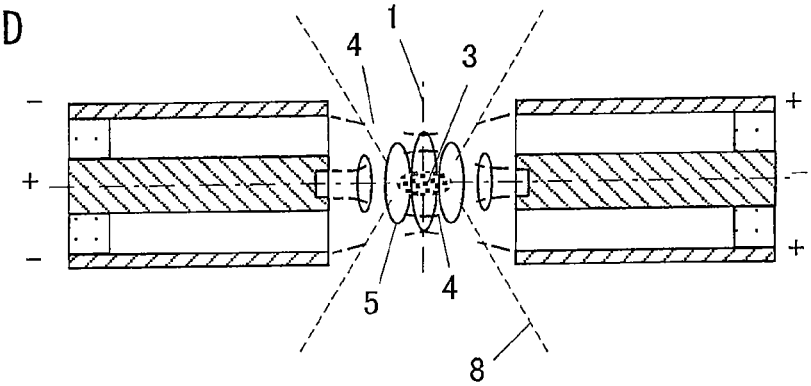
FIG. 2D illustrates a state where magnetic field confining plasma is formed.

FIGS. 2A to 2D explain the operation of the plasma light source of FIG. 1. FIG. 2A illustrates a state where sheet-discharge occurs, FIG. 2B illustrates a state where the sheet-discharge is moving, FIG. 2C illustrates a state where plasma is formed, and FIG. 2D illustrates a state where magnetic field confining plasma is formed.

Referring now to FIGS. 2A to 2D, a plasma light generation method of the present invention is described below.

In the plasma light generation method of the present invention, the above-stated pair of coaxial electrodes 10 is disposed facing each other, the radiation environment sustaining device 20 supplies a plasma medium to the inside of the coaxial electrodes 10 and keeps the coaxial electrodes 10 at a temperature and a pressure suitable for plasma generation, and the voltage application device 30 applies a discharge voltage of an inverted polarity to each of the coaxial electrodes 10.

As illustrated in FIG. 2A, the applied voltage generates sheet-discharge current (hereinafter called sheet-discharge 2) at a surface of the insulator 16 of each of the pair of coaxial electrodes 10. The sheet-discharge 2 is a sheet-shaped discharge current that flows across the center electrode 12 and the guide electrode 14 and two-dimensionally extends when viewed from the axial direction of the coaxial electrodes 10, which will be called a "current sheet" in the below-described examples.

At this time, the center electrode 12 of the coaxial electrode 10 on the left side is charged with positive voltage (+), and the guide electrode 14 thereof is charged with negative voltage (−), whereas the center electrode 12 of the coaxial electrode 10 on the right side is charged with negative voltage (−), and the guide electrode 14 thereof is charged with positive voltage (+).

Alternatively, the guide electrode 14 on each side may be grounded to be kept at 0 V, and the center electrode 12 on one side may be charged with positive voltage (+) and the center electrode 12 on the other side may be charged with negative voltage (−).

As illustrated in FIG. 2B, the sheet-discharge 2 moves in a direction (direction toward the center of the drawing) emitted from its electrode due to self magnetic field.

As illustrated in FIG. 2C, when the sheet-discharge 2 reaches an end of each of the pair of coaxial electrodes 10, a plasma medium 6 sandwiched between the pair of sheet-discharge 2 becomes at a high density and a high temperature, so that single plasma 3 is formed at an intermediate position (at the symmetry plane 1 of the center electrodes 12) of the opposed coaxial electrodes 10. Herein, "single" in the "single plasma 3" means that the plasma 3 extends in a limited small area. Such an extending area of the plasma 3 appears a spot when viewed from the direction of the axial line Z-Z. As one example, the plasma 3 extends in an area of only about 1 to 2 mm in the direction perpendicular to the direction of the axial line Z-Z, and extends in an area of only about 3 to 4 mm in the direction of the axial line Z-Z. Dimensions of these areas will vary in accordance with the dimensions of the coaxial electrodes 10 and other discharge conditions.

Further, in this state, the opposed pair of center electrodes 12 is charged with positive voltage (+) and negative voltage (−), and similarly the opposed pair of guide electrodes 14 is charged with positive voltage (+) and negative voltage (−). Accordingly, as illustrated in FIG. 2D, the sheet-discharge 2 is converted into tubular discharge 4 discharging between the opposed pair of center electrodes 12 and between the opposed pair of guide electrodes 14. Herein, the tubular discharge 4 means a hollow-cylindrical discharge current surrounding the axial line Z-Z.

When this tubular discharge 4 is formed, plasma confining magnetic field (magnetic bottle) indicated by reference numeral 5 in the drawing is formed, whereby plasma 3 can be confined in the radial direction and the axial direction.

That is, the magnetic bottle 5 becomes large on the center part and small on both sides due to pressure of the plasma 3 so that magnetic pressure gradient in the axial direction is formed toward the plasma 3. This magnetic pressure gradient constrains the plasma 3 at the center position. Further, the plasma 3 is compressed (Z-pinched) in the direction toward the center by self magnetic field of a plasma current, and is constrained in the radial direction as well by self magnetic field.

In this state, energy corresponding to light emission energy of the plasma 3 continuously supplied from the voltage application device 30 allows plasma light 8 (EUV) to be generated stably for a long time with high energy conversion efficiency.

According to the above-described apparatus and method of the present invention, the apparatus includes a pair of coaxial electrodes 10 disposed facing each other. A sheet-discharge current (sheet-discharge 2) is generated at each of the pair of coaxial electrodes 10, and the pair of sheet discharge 2 causes single plasma 3 to be formed at an intermediate position of the opposed pair of coaxial electrodes 10. Next, the sheet-discharge 2 is converted into tubular discharge 4 between the pair of coaxial electrodes to form plasma confining magnetic field 5 (magnetic field bottle 5) confining the plasma 3. As a result, plasma light for EUV radiation can be generated stably for a long time (in the order of microseconds).

As compared with conventional capillary discharging and vacuum discharged metal plasma, single plasma 3 is formed at an intermediate position of the opposed pair of coaxial electrodes 10, and energy conversion efficiency can be improved significantly (10 times or greater). As a result, heat load to each electrode during plasma formation can be reduced so that damage to constituting devices due to heat load can be significantly reduced.

Further, since plasma 3 as a light emission source of plasma light is formed at an intermediate position of the opposed pair of coaxial electrodes 10, an effective radiant solid angle of the plasma light generated can be increased.

Figure 3:
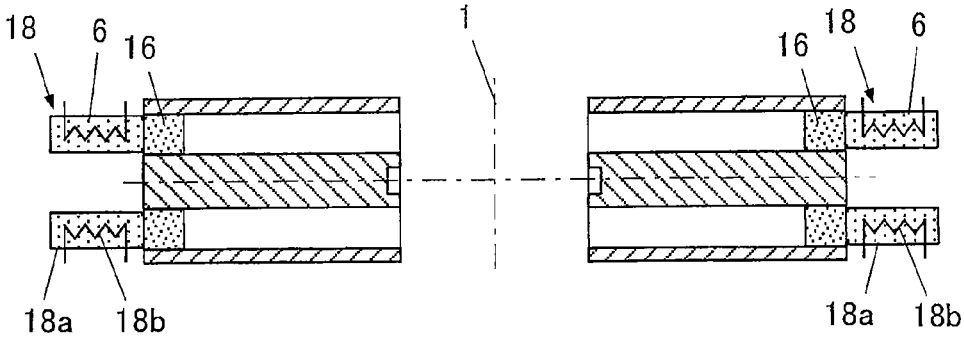
FIG. 3 illustrates a plasma light source according to Embodiment 2 of the present invention.

FIG. 3 illustrates a plasma light source according to Embodiment 2 of the present invention.

In this example, a ring-shaped insulator 16 is made of porous ceramic. The plasma light source according to the present invention is further provided with a plasma medium feeder 18.

The plasma medium feeder 18 is provided in intimate contact with an outer face of the porous ceramic 16, and supplies a plasma medium into the inside of a coaxial electrode 10 (between a center electrode 12 and a guide electrode 14) via the porous ceramic 16.

The plasma medium feeder 18, in this example, includes a reservoir 18*a* (e.g., a crucible) keeping a plasma medium 6 therein, and a heater 18*b* that liquefies the plasma medium. The plasma medium preferably is Sn, Li or the like that is a solid at room temperatures, in this example.

The other configuration is the same as in Embodiment 1.

In the plasma light generation method of the present invention, using the plasma light source of FIG. 3, the porous ceramic 16 is heated and maintained at a temperature such that the vapor pressure of the plasma medium 6 (e.g., Sn, Li) is at a pressure (Torr order) suitable for plasma generation, thus making the interior of the coaxial electrode 10 (between the center electrode 12 and the guide electrode 14) in a vapor atmosphere of the plasma medium 6 of Torr order.

Further, electrode conductors (the center electrode 12 and the guide electrode 14) are kept at a high temperature so as not to cause the aggregation of steam of the plasma medium 6.

With the above-stated configuration, the plasma medium 6 can be continuously supplied to the coaxial electrode 10 so that plasma light for EUV radiation can be generated stably for a long time (in the order of microseconds).

Figure 4:
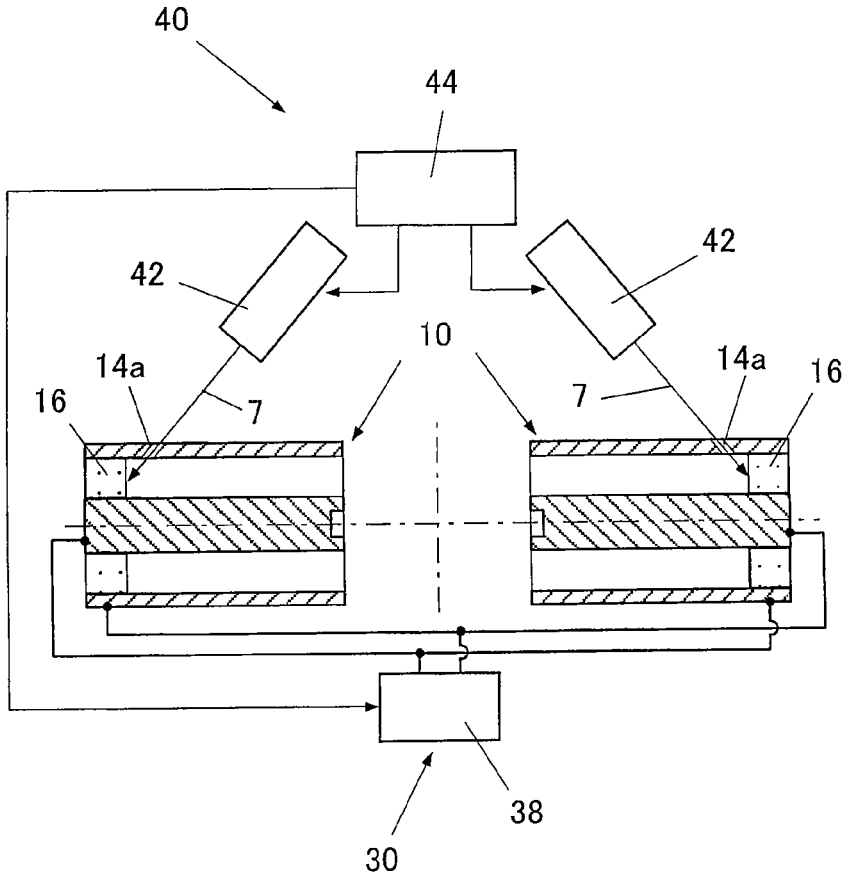
FIG. 4 illustrates a plasma light source according to Embodiment 3 of the present invention.

FIG. 4 illustrates a plasma light source according to Embodiment 3 of the present invention.

In this example, a plasma light source according to the present invention is further provided with a ignition laser device 40.

The ignition laser device 40 in this example includes two laser oscillators 42 and a timing controller 44, and is configured to apply laser light 7 to a surface of an insulator 16 of each of a pair of coaxial electrodes 10 in synchronization with a timing of discharge voltage application by a voltage application device 30.

In this drawing, reference numeral 14*a* denotes an aperture provided at a guide electrode 14, through which the laser light 7 passes. This aperture 14*a* may be blocked with transparent body (e.g., quartz glass) letting the laser light 7 pass therethrough.

In FIG. 4, the voltage application device 30 is a pulsed high-voltage power supply 38 configured to apply discharge voltage of an inverted polarity on the right and left sides to the center electrode 12 and the guide electrode 14 of each of a pair of the coaxial electrodes 10. The voltage application device 30 may have the configuration illustrated in FIG. 1.

The other configuration is the same as in Embodiment 1.

With the above-stated configuration, the laser light 7 is applied to a surface of the insulator 16 in synchronization with a timing of the discharge voltage application, whereby discharge jitter can be reduced and coincidences of the discharge start timings by the opposed coaxial electrode 10 can be achieved.

Figure 5A:
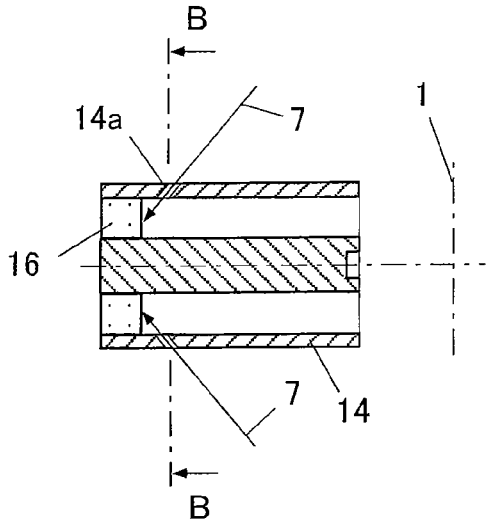
FIG. 5A illustrates a plasma light source according to Embodiment 4 of the present invention.
Figure 5B:
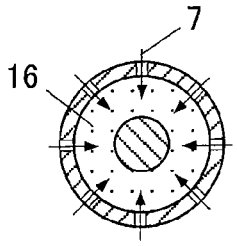
FIG. 5B is a cross-sectional view taken along the line B-B of FIG. 5A.

FIG. 5A and FIG. 5B illustrate a plasma light source according to Embodiment 4 of the present invention.

FIG. 5A illustrates one of a pair of coaxial electrode 10 and FIG. 5B is a cross-sectional view taken along the line B-B.

In this example, an ignition laser device 40 is configured to apply laser light 7 at a lot of (a plurality of) positions on a surface of each insulator 16. A lot of (a plurality of) positions for application of laser light are spaced at regular intervals in the circumferential direction of each insulator 16, and in this example are eight positions in the circumferential direction. In order to divide the laser light 7 into a plurality of positions, a beam splitter may be used, for example, and their optical lengths are brought into the same.

In this way, the laser light 7 is divided so as to be applied at a lot of positions spaced at regular intervals in the circumferential direction of each insulator 16, whereby discharge jitter in the circumferential direction can be reduced, and coincidences of the discharge start timings in the circumferential direction can be achieved.

Example 1

1. Initial Current Distribution and Longer-Pulsed Light Source Plasma (Experiment by Capillary Discharge)

Capillary discharge is one of the simplest method for DPP generation. In the capillary discharge, electrodes are provided at both ends of a cylindrical insulator capillary, and a high voltage is applied between the electrodes, whereby discharge plasma is formed in the capillary.

The present inventors changed the shape of a capillary to investigate influences of the initial current distribution on duration of EUV plasma.

(Experimental Device)

Figure 6A:
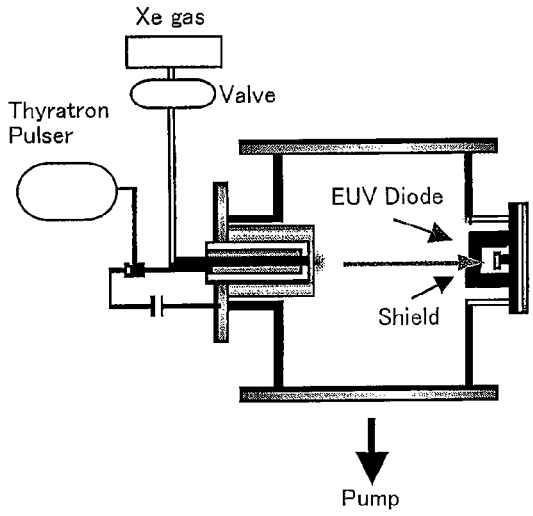
FIG. 6A illustrates overview of an experimental device.
Figure 6B:
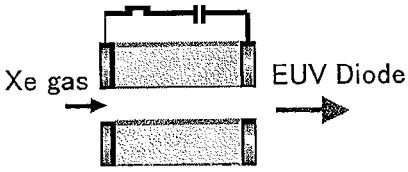
FIG. 6B schematically illustrates a straight-type capillary.
Figure 6C:
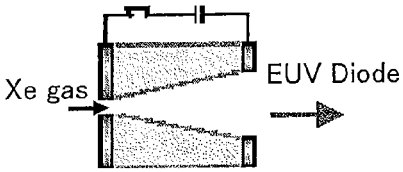
FIG. 6C schematically illustrates a taper-type capillary.

FIGS. 6A, 6B and 6C illustrate overview of a capillary discharge apparatus. FIG. 6A illustrates the overview of an experimental device, and FIGS. 6B and 6C schematically illustrate a straight-type capillary and a taper-type capillary, respectively.

The straight-type capillary (FIG. 6B) has a length of 10 mm and an inner diameter of 3 mm. The taper-type capillary (FIG. 6C) has a length of 10 mm and inner diameters of 2 mm and 8 mm on the anode side and on the cathode side, respectively. The capillary has a Laval nozzle structure, where Xe gas supplied into the capillary by an electronic controlled valve is accelerated up to supersonic speeds in the nozzle. Since gas is injected like a pulse, DPP can be driven while keeping the interior of the chamber at vacuum of about $10^{-6}$ torr. EUV signals were measured using a photodiode (produced by IRD Inc., AXUV20HS1) placed in a capillary axial direction.

(Results and Consideration)

Figure 7A:
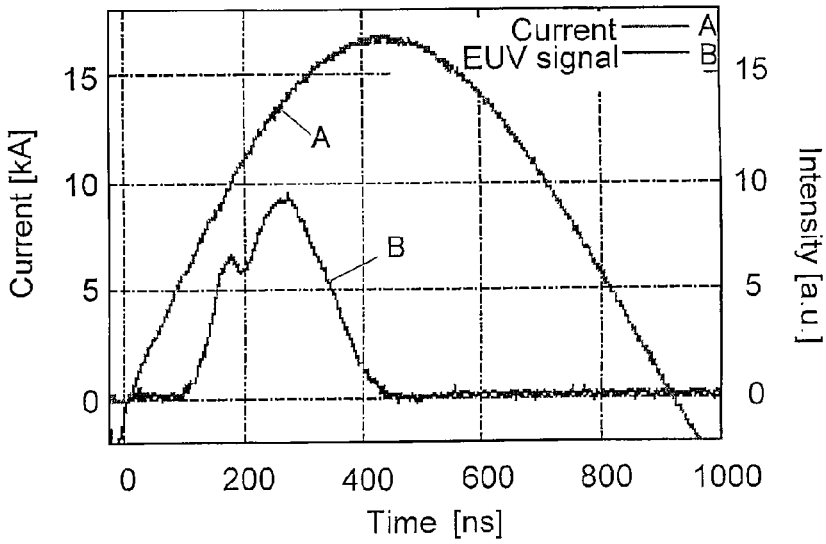
FIG. 7A illustrates a typical EUV signal of straight type.
Figure 7B:
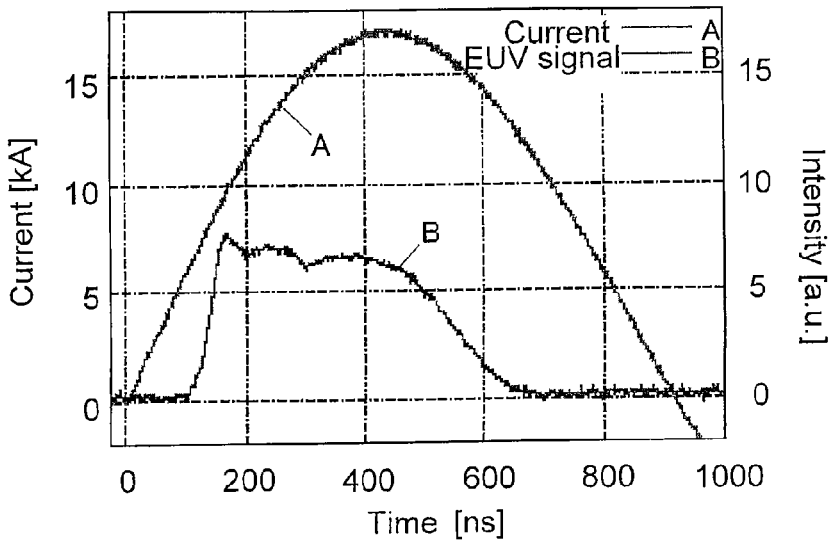
FIG. 7B illustrates a typical EUV signal of taper type.

FIG. 7A and FIG. 7B illustrate effects of the initial current distribution on an EUV signal. FIG. 7A illustrates a typical EUV signal of a straight type and, FIG. 7B illustrates a typical EUV signal of a taper type. In the drawings, A indicates an input current and B indicates an EUV signal.

From FIG. 7A and FIG. 7B, it can be clearly found that duration of the EUV signal B is increased more in the taper type. In a straight-type capillary discharge typically used for DPP, plasma is compressed (Z-pinched) toward a center by self magnetic field of a plasma current at a capillary creepage surface. The plasma compressed and heated by this Z-pinch becomes at a high temperature and high-density state, and after maximum compression, the plasma rapidly expands due to increased pressure. As a result, the plasma in an EUV radiation state can exist only for a short time.

The intensity $P_B$ of the self magnetic field is represented by the following expression (2):

$$P_B \propto ((I^2/r^2) \quad (2),$$

where I is a plasma current and r is a plasma radius. In a taper-type capillary discharge plasma having gradient in the axial direction, self magnetic field is strong on the anode side with a small plasma radius r, and the plasma is compressed in the radial direction by the gradient in the axial direction within the capillary. At the same time, the plasma drifts from the anode side to the cathode side along the central axis. It is considered that the plasma moving in the capillary is continuously heated, and its high-temperature and high-density state is maintained for a long time.

However, even in the case of taper capillary discharge, the Z-pinched plasma moves in the axial direction, and further is emitted out of the capillary and expands naturally, so that an obtained EUV radiation time was only about 300 nsec. Further, since the plasma was generated in the capillary, an obtained effective solid angle was not sufficient. As a result, it was found that the taper capillary discharge had a difficulty in obtaining the required light source property.

Example 2

2. Experiment Using Cusped Magnetic Field Guide

Based on the above-stated experiment result, it was confirmed that gradient in the radial direction of current causes a difference in magnetic pressure, enabling plasma controlled in the axial direction as well. Since the rate of plasma expansion (thermal velocity) is about 1 cm/μsec, plasma confinement not only in the radial direction but also in the axial direction has to be achieved for confining in the order of microseconds with consideration given to the size of light source plasma. Thus, achievement of current distribution with a small radius on both electrode sides and with a maximum radius at the center between electrodes as well as the ability of driving a current waveform most suitable for the current distribution will enable a constraint force due to self magnetic field acting in the radial direction and a constraint force due to magnetic pressure gradient acting in the axial direction. As a result, constraint of plasma for a long time will be achieved.

Figure 8:
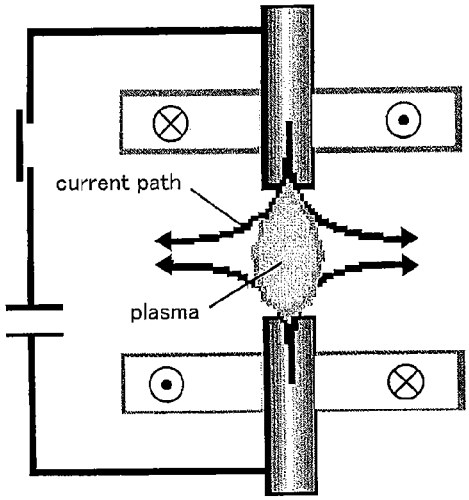
FIG. 8 schematically illustrates an experiment of cusped magnetic field guide discharging.

FIG. 8 schematically illustrates an experiment of cusped magnetic field guide discharging.

This drawing illustrates the concept of current distribution control by applied magnetic field. A permanent magnet was disposed around each of the electrodes as illustrated in the drawing, and controlling of an initial current path due to cusped type magnetic field was attempted. At the moment that high voltage was applied to the electrodes, electrons jumping out of the cathode generate electron avalanche while moving to the anode under the control of electric field and cusped type magnetic flux. As a result, the formation of current distribution as illustrated is expected.

In a proof-of-concept experiment, the electrodes had a diameter of 2 mm, a length between electrodes was 4 mm, a magnet had a surface magnetic flux density of 1.25 T and an inner diameter of 24 mm and an outer diameter of 50 mm, and a length between magnets was 8 mm.

As a result of the proof-of-concept experiment, stronger light emission was observed in the vicinity of the center between electrodes due to guide by magnetic field B. Further, preliminary ionization successfully led to a somewhat stable discharge. However, repeatability thereof was poor, and a stable result could not be obtained. Conceivably, this is because the formation of a current path greatly depends on an electron avalanche path that is instable at an early stage. An EUV light source assumes high stability of repetition of 1 to 10 kHz to obtain an output, and therefore instability of the plasma formation leads to degradation in output and efficiency.

Example 3

3. Z-pinch by Counter-Facing Plasma Focus System

Figure 9:
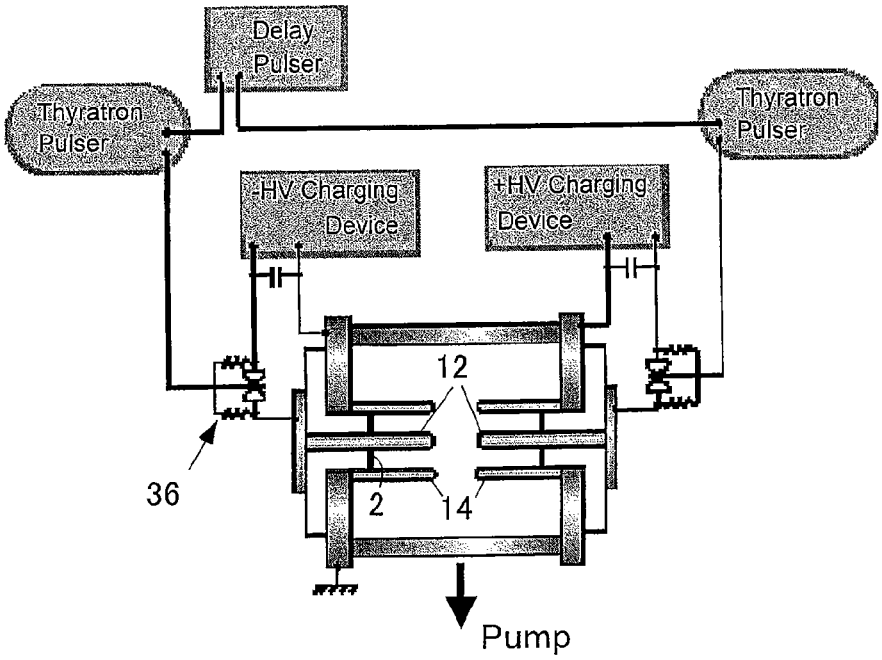
FIG. 9 schematically illustrates the configuration of a counter-facing plasma focus apparatus.
Figure 10A:
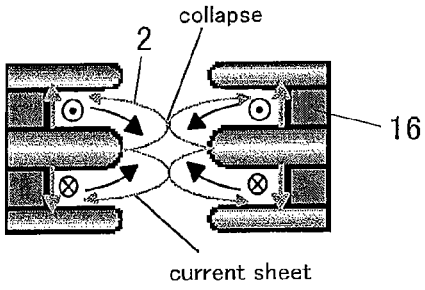
FIG. 10A illustrates the state where current sheets collide at a center between the electrodes.
Figure 10B:
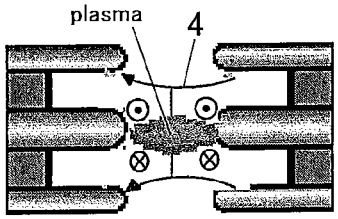
FIG. 10B illustrates the time when a magnetic field confining plasma is formed.
Figure 10C:
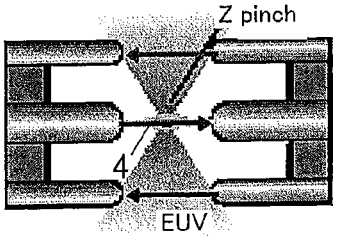
FIG. 10C illustrates the time when EUV light is emitted.

FIG. 9 schematically illustrates a counter-facing plasma focus apparatus, and FIGS. 10A, 10B and 10C illustrate the expected behavior of plasma by reconnecting of current.

In order to establish a method for generating EUV plasma and confining the same stably, a DPP formation method is proposed in which a counter-facing plasma focus system. As illustrated in FIG. 9, coaxial plasma focus electrodes face each other. In each plasma focus electrode, an outer guide electrode 14 is grounded, and positive and negative high voltage is applied to an inner electrode (center electrode 12). When high voltage is applied to the coaxial electrodes (guide electrodes 14 and center electrodes 12), discharge starts at a creepage surface of an insulator 16 (see FIGS. 10A, 10B and 10C). A current sheet (sheet-discharge 2) formed at an insulator face is pushed toward the outside of the electrode due to self magnetic field.

Devising on the insulator surface such as the installation of a metal trigger pin may reduce a threshold of the discharge start voltage between the coaxial electrodes smaller than the applied voltage. In such a case, discharge jitter will be reduced. Herein, discharge jitter means a delay time from voltage application to discharge start.

Discharge jitter sufficiently smaller than a current sheet advancing time in gap between the electrodes enables the collision in the vicinity of the center between electrodes. When the collision of current sheets occurs at the center between electrodes, if the current path and the magnetic field collapse temporarily and then reconnecting occurs, a shape enabling the plasma behavior as illustrated in FIGS. 10A, 10B and 10C and plasma constraint for a long time can be expected.

Reconnecting (converting) refers to a change in current path and magnetic field from the discharging (state of FIG. 10A) between an inner electrode (center electrode 12) and an outer electrode (guide electrode 14) to the discharging (state of FIG. 10B) between opposed pair of inner electrodes (center electrodes 12) and between opposed pair of outer electrodes (guide electrodes 14). This reconnecting can be automatically conducted by adjusting a space between the pair of coaxial electrodes and by changing a discharge voltage, for example.

A current waveform can be controlled by circuit parameters. After successful reconnecting, if a balance between the pressure gradient of plasma and the magnetic pressure gradient in radial direction and in the axial direction can be established by an optimum current waveform, plasma can be constrained in the order of microseconds.

An important point in this experiment resides in simultaneity of discharge start, uniformity of current sheets, and reconnecting of current sheets when the simultaneity and the uniformity are achieved. For uniform current sheet collision, an experiment to confirm the emission of uniform current sheet was conducted firstly.

(Experimental Device)

Figure 11:
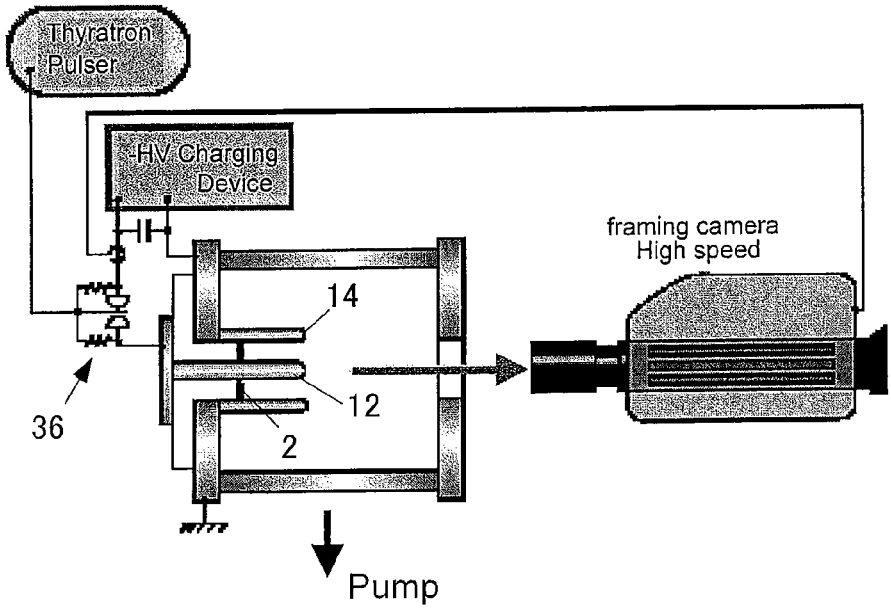
FIG. 11 schematically illustrates an experimental device for a plasma light source including coaxial electrodes.

FIG. 11 schematically illustrates an experimental device for a plasma light source including a coaxial electrode.

In this drawing, the center electrodes 12 had a diameter of 5 mm, the outer guide electrode 14 had an inner diameter of 10 mm, and these electrodes had curvature at their edges to prevent discharge start at the tip end. The coaxial electrodes (center electrode 12 and guide electrode 14) were separated by an insulator (not illustrated), and a needle-like trigger pin was installed at a surface of the insulator so as to start uniform and stable discharge.

A depth of the coaxial electrode (a length from the insulator surface to the tip end of the coaxial electrode) can be changed by adjusting the length of the insulator. The capacitor capacity was 1 μF, the applied voltage was 10 to 15 kV, and the circuit inductance was 0.4 μH. In order to check the overall behavior of current sheet, a high-speed framing camera (produced by DRS HADLAND Ltd. IMACON468) was disposed in the axial direction for observation in a visible light area.

(Results and Consideration)

Figure 12A:
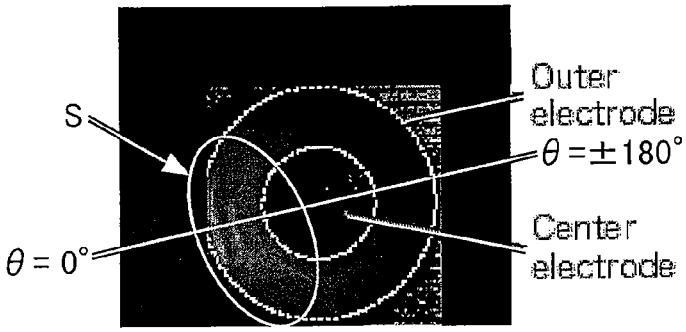
FIG. 12A illustrates an experimental result showing the extending of a current sheet at the coaxial electrode.
Figure 12B:
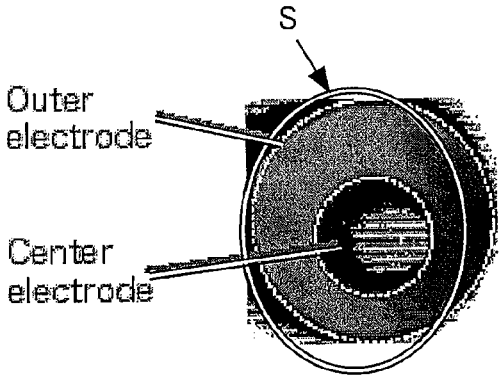
FIG. 12B illustrates another experimental result showing the extending of a current sheet at the coaxial electrode.

FIG. 12A and FIG. 12B illustrate an experimental result showing the extending of a current sheet at the coaxial electrode. FIG. 12A and FIG. 12B are views from the direction of the axial line Z-Z in the configuration of FIG. 1. In FIG. 12A and FIG. 12B, "Center Electrode" and "Outer electrode" correspond to the rod-shaped center electrode 12 and the tubular guide electrode 14, respectively.

FIG. 12A and FIG. 12B illustrate a state where −15 kV was applied to the center electrode, and driving was performed with a current of sinusoidal waveform (period of 4 μsec). A discharge peak current and an initial gas pressure at this time were 4 kA and 110 mtorr (Ar), respectively, and an exposure time was 100 nsec. FIG. 12A illustrates a state of plasma extending immediately after the discharge started, and FIG. 12B illustrates a state of plasma extending after time (about 400 ns) has elapsed from the discharge start. In these drawings, an area indicated by arrow S shows the extending of plasma.

In FIG. 12A and FIG. 12B, an azimuth angle θ is a rotation angle indicating a circumferential position around the center electrode 12, and a position of θ=0° and a position of θ=±180° are illustrated. It can be understood that extending of 180 degrees or greater occurs in the azimuth angle θ direction until the discharge starting from one position (i.e., the position of θ=0°) reaches a peak current. Based on this result, it can be understood that a current sheet in the coaxial electrode tends to extend in the θ direction. That is, under the above-stated discharge condition, uniformity of a current sheet can be obtained by letting discharge start at two or more positions.

As can be understood from FIG. 12B and the configuration of FIG. 1, the present invention enables the configuration without any shield on the outside in the plasma radial direction (with reference to the axial line Z-Z), and therefore the effective radiant solid angle of plasma light can be made larger.

As a result of observation of plasma emission while changing the electrode depth, plasma emission was confirmed at the electrode depth of 20 mm. Based on the electrode depth and the time between the plasma discharge start and the plasma emission, the velocity of the current sheet estimated is estimated at about 1 cm/μsec under the above-stated condition. Since a gap between the electrodes is about 5 to 10 mm, a permissible time lag for discharge start between both electrodes is about 100 nsec.

Based on the above-stated experiment, a benchmark for current sheet collision was obtained for the simultaneity in discharge start and the uniformity of a current sheet. Discharge jitter is a feasible value in terms of a performance of the device, and two or more discharge start points can be formed by devising the trigger pin.

As stated above, the present inventors measured EUV radiation of Xe plasma using a taper-type capillary, and compared the result with that in conventional capillary discharge. It was found that EUV light emission time was lengthened by the manipulation of current waveforms. In the case of using the taper-type capillary, the radiation duration was extended about 1.5 times the case of operating the straight type capillary under a similar discharge condition. It becomes clear that the manipulation of discharge current is important to extend the radiation duration. It becomes clear that, although the discharge duration was extended 1.5 times, the discharge time of 300 nsec is still far from the goal for improvement in output and efficiency.

In order to cope with these problems, the present inventors conducted the experiment using cusped magnetic field as a guide for emitted electrons as a potential method capable of handling initial current distribution. Although a guide effect by the magnetic field was confirmed in the experiment, the guide effect was not effective as in the taper-type capillary, and stable plasma shape was not found. Conceivably, this is because the plasma formation strongly depends on an instable path of initially emitted electrons.

For a method of forming EUV plasma and confining the same stably, the present inventors proposed a method of making a pair of plasma focuses face each other, each having an inverted polarity. Successful simultaneity in discharge, uniformity of a current sheet and reconnecting of the current sheet will allow the plasma to be compressed in the axial direction while being maintained due to self magnetic field, whereby a plasma shape of stable orientation that is suitable for long-time EUV radiation can be formed. The formation of light source plasma controlled in terms of space and time can improve the energy conversion efficiency of an EUV plasma light source.

The above described embodiments are to be considered in all respects as illustrative and not restrictive. The scope of the invention is indicated by the appended claims. All changes which come within the meaning and range of equivalency of the claims are intended to be embraced therein.

The invention claimed is:

1. A plasma light source, comprising:

(a) a pair of coaxial electrodes facing each other;

(b) a radiation environment sustaining device that supplies a plasma medium into insides of the pair of coaxial electrodes and holds the pair of coaxial electrodes at a temperature and a pressure suitable for plasma generation; and (c) a voltage application device that applies a discharge voltage of an inverted polarity to each coaxial electrode of the pair of coaxial electrodes, wherein the each coaxial electrode of the pair of coaxial electrodes includes a center electrode and a guide electrode surrounding the center electrode with a space kept therebetween, wherein the voltage application device includes:

(i) a positive voltage source that applies, to the center electrode of one of the pair of coaxial electrodes, a positive voltage higher than a voltage at the guide electrode of one of the pair of coaxial electrodes; and (ii) a negative voltage source that applies, to the center electrode of the other of the coaxial electrodes, a negative voltage lower than a voltage at the guide electrode of the other of the coaxial electrodes, wherein the plasma light source is configured so that the voltage application device applies a discharge voltage of an inverted polarity to the each coaxial electrode of the pair of coaxial electrodes so as to generate a sheet-discharge at each of the pair of coaxial electrodes so that each of the sheet-discharges moves to an end of the coaxial electrode, and the sheet-discharges cause single plasma to be formed at an intermediate position between the pair of coaxial electrodes facing each other, and the sheet-discharges are converted into tubular discharges between the pair of coaxial electrodes to confine the plasma in a radial direction and an axial direction of the pair of coaxial electrodes, and wherein the tubular discharges include: the tubular discharge generated between the center electrode of the one of the pair of coaxial electrodes and the center electrode of the other of the pair of coaxial electrodes; and the tubular discharge generated between the guide electrode of the one of the pair of coaxial electrodes and the guide electrode of the other of the pair of coaxial electrodes.

2. The plasma light source according to claim 1, wherein the center electrode of the each coaxial electrode extends along a single axial line, wherein each coaxial electrode includes:

a ring-shaped insulator positioned between the center electrode and the guide electrode and electrically insulating the center electrode from the guide electrode, and each of the center electrodes of the pair of coaxial electrodes are positioned along the axial line common thereto and are symmetrically positioned with a space kept therebetween.

3. The plasma light source according to claim 2, wherein the voltage application device includes:

a trigger switch that lets the positive voltage source and the negative voltage source apply a voltage to the respective coaxial electrode concurrently.

4. The plasma light source according to claim 2, wherein the insulator is porous ceramic, and the plasma light source further includes:

(d) a plasma medium feeder that supplies a plasma medium into an inside of the coaxial electrodes via the porous ceramic, and the plasma medium feeder includes a reservoir holding the plasma medium therein and a heater liquefying the plasma medium.

5. The plasma light source according to claim 2, further comprising:

an ignition laser device that applies laser light to a surface of the insulator of each coaxial electrode of the pair of coaxial electrodes in synchronization with an application timing of the discharge voltage.

6. A plasma light source, comprising:

(a) a pair of coaxial electrodes facing each other;

(b) a radiation environment sustaining device that supplies a plasma medium into insides of the pair of coaxial electrodes and holds the pair of coaxial electrodes at a temperature and a pressure suitable for plasma generation; and (c) a voltage application device that applies a discharge voltage of an inverted polarity to each coaxial electrode of the pair of coaxial electrodes, wherein tubular discharge is formed between the pair of coaxial electrodes, and plasma is confined in an axial direction of the pair of coaxial electrodes, wherein each coaxial electrode includes:

(i) a rod-shaped center electrode extending along a single axial line;

(ii) a tubular guide electrode surrounding the center electrode with a constant space kept therebetween; and (iii) a ring-shaped insulator positioned between the center electrode and the guide electrode and electrically insulating the center electrode from the guide electrode, and the center electrodes of the pair of coaxial electrodes are positioned along an axial line common thereto and are symmetrically positioned with a space kept therebetween, wherein the plasma light source further comprising:

an ignition laser device that applies laser light to a surface of the insulator of each coaxial electrode of the pair of coaxial electrodes in synchronization with an application timing of the discharge voltage, and wherein the ignition laser device applies laser light at a plurality of positions on a surface of each insulator.

7. A plasma light generation method, comprising the steps of:

(a) disposing a pair of coaxial electrodes facing each other, wherein the each of the coaxial electrodes includes a center electrode and a guide electrode surrounding the center electrode with a space kept therebetween;

(b) supplying a plasma medium into insides of the pair of coaxial electrodes and holding the pair of coaxial electrodes at a temperature and a pressure suitable for plasma generation; and (c) applying. to the center electrode of one of the pair of coaxial electrodes, a positive discharge voltage higher than a voltage at the guide electrode of the one of the pair of coaxial electrodes, and applying, to the center electrode of the other of the coaxial electrodes, a negative discharge voltage lower than a voltage at the guide electrode of the other of the coaxial electrodes so as to generate sheet-discharge at each of the pair of coaxial electrodes, so as to move each of the sheet-discharges to an end of the coaxial electrode so that the sheet-discharges cause single plasma to be formed at an intermediate position between the pair of coaxial electrodes facing each other, and the sheet-discharges are converted into tubular discharges between the pair of coaxial electrodes to confine the plasma in a radial direction and an axial direction of the pair of coaxial electrodes, wherein the tubular discharges include: the tubular discharge generated between the center electrode of the one of the pair of coaxial electrodes and the center electrode of the other of the pair of coaxial electrodes, and the tubular discharge generated between the guide electrode of the one of the pair of coaxial electrodes and the guide electrode of the other of the pair of coaxial electrodes.

* * * * *